US009383108B2

(12) United States Patent
Touma

(10) Patent No.: US 9,383,108 B2
(45) Date of Patent: Jul. 5, 2016

(54) REMOVABLE OVEN FOR GRILL

(76) Inventor: Albert Touma, Houston, TX (US)

( * ) Notice: Subject to any disclaimer, the term of this patent is extended or adjusted under 35 U.S.C. 154(b) by 650 days.

(21) Appl. No.: 13/535,080

(22) Filed: Jun. 27, 2012

(65) Prior Publication Data

US 2014/0000585 A1 Jan. 2, 2014

(51) Int. Cl.
*F24B 1/20* (2006.01)
*F24B 1/00* (2006.01)

(52) U.S. Cl.
CPC ..... *F24B 1/003* (2013.01)

(58) Field of Classification Search
CPC ..... F24B 1/003; A21B 2/00; A21B 1/44; A21B 1/40; F24C 15/16; F24C 7/00; F24C 15/108
USPC ..... 126/9 R; 219/754, 755; 108/139; 273/280; 104/35–47; 47/39
See application file for complete search history.

(56) References Cited

U.S. PATENT DOCUMENTS

| | | | | | |
|---|---|---|---|---|---|
| 497,275 | A | * | 5/1893 | Glasmann | 126/9 R |
| 641,575 | A | | 1/1900 | Boud | |
| 898,527 | A | | 9/1908 | Thoits et al. | |
| RE13,110 | E | | 5/1910 | Thoits et al. | |
| 1,049,633 | A | | 9/1913 | Whitmer | |
| 1,072,231 | A | | 9/1913 | Howell | |
| 1,404,808 | A | | 1/1922 | Herman | |
| 2,019,604 | A | | 11/1935 | Grieve | |
| 2,095,654 | A | * | 10/1937 | Thoreson | 126/9 R |
| 2,129,371 | A | * | 9/1938 | Robinson | 126/9 R |
| 2,880,951 | A | * | 4/1959 | Springer | 248/131 |
| 2,907,316 | A | * | 10/1959 | Windust | 126/9 B |
| 3,055,721 | A | * | 9/1962 | Holt | 108/139 |
| 3,095,186 | A | | 6/1963 | Sondy | |
| 3,313,917 | A | | 4/1967 | Ditzler et al. | |
| 3,428,039 | A | * | 2/1969 | Becker et al. | 126/9 R |
| 3,809,051 | A | * | 5/1974 | Giroux | 126/9 R |
| 3,892,222 | A | * | 7/1975 | Darbo | 126/9 R |
| 3,952,721 | A | | 4/1976 | Patterson | |
| 4,051,837 | A | * | 10/1977 | Norman | 126/275 R |
| 4,123,058 | A | * | 10/1978 | Furyk et al. | 273/108.21 |
| 4,126,778 | A | | 11/1978 | Cole | |
| 4,137,442 | A | * | 1/1979 | Tateda | 219/685 |
| 4,140,099 | A | * | 2/1979 | Newport | 126/9 A |
| 4,424,431 | A | * | 1/1984 | Gurubatham | 219/754 |
| 4,437,396 | A | | 3/1984 | Plattner et al. | |
| 4,455,319 | A | | 6/1984 | Clark | |
| 4,498,376 | A | | 2/1985 | Carey | |

(Continued)

FOREIGN PATENT DOCUMENTS

| | | |
|---|---|---|
| FR | 2670870 A1 | 6/1992 |
| WO | 8304161 A1 | 8/1983 |

*Primary Examiner* — Kenneth Rinehart
*Assistant Examiner* — Jason Lau
(74) *Attorney, Agent, or Firm* — Royston Rayzor Vickery & Williams L.L.P.; William P. Glenn, Jr.

(57) ABSTRACT

A removable oven for use on a cooking grill including a cooking chamber formed in a high temperature housing with an open bottom. The open bottom of the high temperature housing fits over a lower cooking plate positioned over the grill. A repositionable upper cooking plate is located in an upper region of the cooking chamber thereby forming a gap that can be varied to control the heat between the cooking plates. A chimney connected to the cooking chamber further controls the heat between the cooking plates. The lower cooking plate can be made to rotate when placed on a rotating assembly.

1 Claim, 6 Drawing Sheets

(56) References Cited

U.S. PATENT DOCUMENTS

| | | | | | |
|---|---|---|---|---|---|
| 4,545,359 | A | * | 10/1985 | Hait | 126/9 R |
| 4,694,132 | A | * | 9/1987 | Liu | 219/755 |
| 4,752,662 | A | * | 6/1988 | Takagi | 219/754 |
| 4,800,865 | A | | 1/1989 | Setzer | |
| 4,805,588 | A | | 2/1989 | Reynolds | |
| 4,889,103 | A | | 12/1989 | Fraioli | |
| 5,039,535 | A | | 8/1991 | Lang et al. | |
| 5,166,486 | A | * | 11/1992 | Komatsu et al. | 219/754 |
| 5,413,033 | A | | 5/1995 | Riccio | |
| 5,440,105 | A | * | 8/1995 | Kim | 219/754 |
| 5,532,456 | A | | 7/1996 | Smith et al. | |
| 5,586,488 | A | | 12/1996 | Liu | |
| 5,883,362 | A | | 3/1999 | Pettibone et al. | |
| 5,945,980 | A | | 8/1999 | Moissev et al. | |
| 6,011,242 | A | | 1/2000 | Westerberg | |
| 6,041,769 | A | | 3/2000 | Llodra et al. | |
| 6,053,094 | A | | 4/2000 | Cados | |
| RE36,724 | E | | 6/2000 | Westerberg et al. | |
| 6,070,572 | A | | 6/2000 | Casagrande | |
| 6,125,740 | A | | 10/2000 | Hedrington et al. | |
| 6,187,359 | B1 | | 2/2001 | Zuccarini | |
| 6,292,396 | B1 | | 9/2001 | Tailliet | |
| 6,354,194 | B1 | | 3/2002 | Hedrington et al. | |
| 6,384,381 | B2 | | 5/2002 | Witt et al. | |
| 6,640,695 | B2 | | 11/2003 | Stark | |
| 6,967,036 | B1 | | 11/2005 | Hedrington et al. | |
| 7,323,663 | B2 | | 1/2008 | Cavada et al. | |
| 7,619,186 | B2 | | 11/2009 | Cavada et al. | |
| 2002/0017290 | A1 | * | 2/2002 | Hines, Jr. | 126/41 R |
| 2002/0060215 | A1 | | 5/2002 | Allera et al. | |
| 2002/0069764 | A1 | | 6/2002 | Cohen | |
| 2002/0179081 | A1 | * | 12/2002 | Holland et al. | 126/25 R |
| 2003/0145740 | A1 | | 8/2003 | Stark | |
| 2005/0034716 | A1 | | 2/2005 | Harbin | |
| 2005/0039612 | A1 | | 2/2005 | Denny | |
| 2005/0173400 | A1 | | 8/2005 | Cavada et al. | |
| 2006/0102167 | A1 | | 5/2006 | Driscoll, Jr. | |
| 2006/0191528 | A1 | | 8/2006 | Spangrud | |
| 2009/0064985 | A1 | * | 3/2009 | Gustavsen | 126/21 A |
| 2010/0084355 | A1 | * | 4/2010 | Parks et al. | 211/181.1 |
| 2010/0147281 | A1 | * | 6/2010 | Gustavsen | 126/21 A |

* cited by examiner

REMOVABLE OVEN FOR GRILL

CROSS-REFERENCES TO RELATED APPLICATIONS

Not Applicable

STATEMENT REGARDING FEDERALLY SPONSORED RESEARCH OR DEVELOPMENT

Not Applicable

THE NAMES OF THE PARTIES TO A JOINT RESEARCH AGREEMENT

Not applicable.

REFERENCE TO A SEQUENCE LISTING

Not applicable.

BACKGROUND OF THE INVENTION (1) Field of the Invention

The present invention relates to a grill for cooking and more particularly, is directed to a removable oven for a grill.

(2) Background of the Invention

There are a number of ovens to cook food. Most modern ovens are built for the specific purpose of cooking food inside a building or home. The heat for modern ovens is typically provided by the combustion of natural gas, electrical resistance, electrical induction or microwave. Most consumer type ovens are incapable of reaching the temperatures achieved in a commercial oven, regardless of the fuel source. And to reach such temperatures in a consumer type oven can be expensive not only for the construction of the oven itself but also the space in which the high temperature oven is installed.

The typical outdoor grill whether gas, charcoal or wood fired provides an abundant high temperature heat source to achieve the temperatures found in a commercial oven. Unfortunately, the cooking chamber in the typical outdoor grill is either too large or inadequate to cook food through radiant and/or convection heat. Ovens like the one disclosed by Gustavsen in U.S. Patent Application No. 2010/0147281 A1, provide a smaller cooking chamber, but are inefficient in the retention and direction of the heat by virtue of the use of a baffle and always open cooking chamber. While the Gustavesen oven has an open cooking chamber at all time for ease of accessing the food being cooked, it does not create or maintain a consistent heat field across the cooking chamber. Finally, the Gustavsen oven does not have any means to control the flow of heat across the cooking chamber or the temperature in the heated gap between the cooking stones.

BRIEF SUMMARY OF THE INVENTION

A removable oven for use on a cooking grill including a cooking chamber formed in a high temperature housing with an open bottom. The open bottom of the high temperature housing fits over a lower cooking plate positioned over the grill. A repositionable upper cooking plate is located in an upper region of the cooking chamber thereby forming a gap that can be varied to control the heat between the cooking plates. A chimney connected to the cooking chamber further control the heat between the cooking plates. The lower cooking plate can be made to rotate when placed on a rotating assembly. The present invention is an efficient removable oven for a cooking grill that can be manufactured at a low cost and operated without any special skills. Other and further objects, benefits, and advantages of the instant invention have been described above, and further below.

DETAILED DESCRIPTION OF THE PREFERRED EMBODIMENTS

Figure 1:
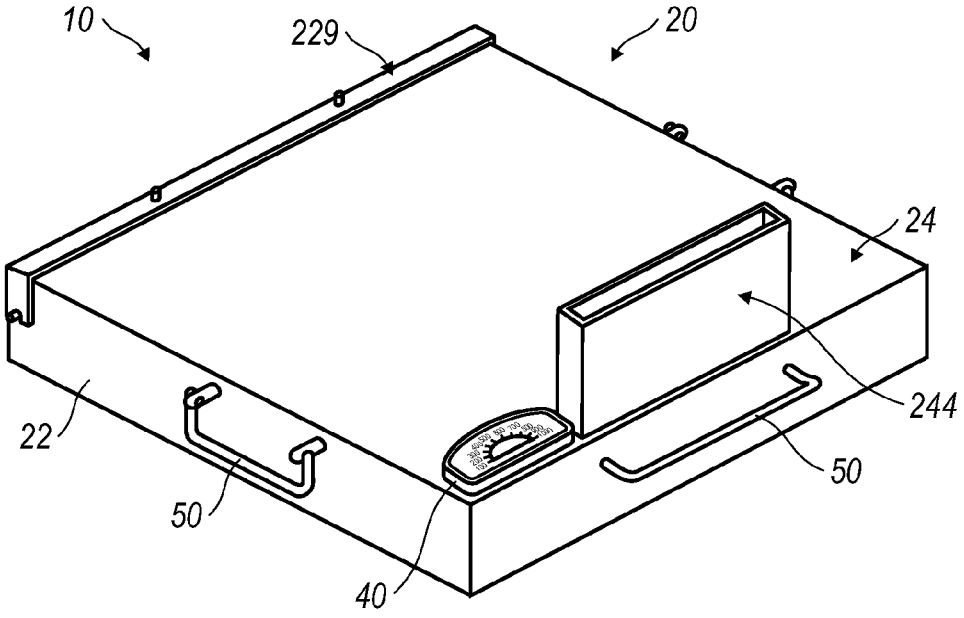
FIG. 1 depicts an isometric view of removable oven.
Figure 2:
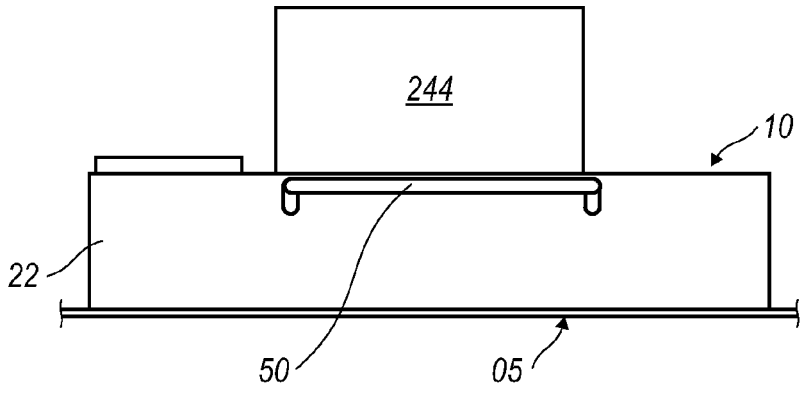
FIG. 2 is a front view of a removable oven depicting the door 224 and chimney 244.

Referring to FIG. 1, the present invention is a removable oven 10 for a grill 05. Beneath the grill 05 is a heat source 03 which can be provided by the combustion of natural gas, wood, or charcoal. See FIG. 6. The removable oven 10 includes a cooking chamber 26 formed in a high temperature housing 20 made of stainless steel or other food safe material capable of withstanding temperatures ranging from about 500° F. to about 1000° F. The high temperature housing 20 consists of a closed top 24, an open bottom 28 and at least one side wall 22 to form a cooking chamber 26. See FIGS. 1, 4, 5, 6 and 7. It is contemplated that the cross section of high temperature housing 20 can be square, rectangular, polygonal or circular. A front opening 222 is formed in a side wall 22 to allow a user to place or remove food from the cooking chamber 26. In a preferred embodiment, the front opening 222 can be covered by a door 224.

Figure 6:
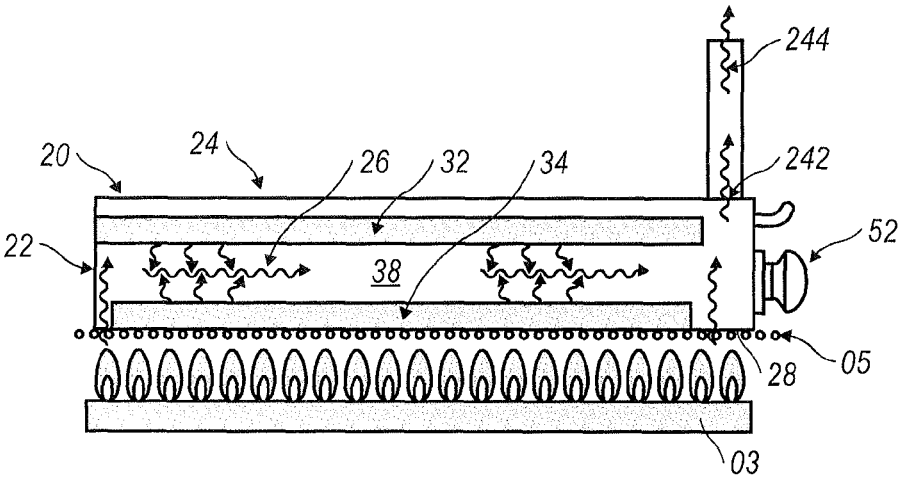
FIG. 6 is a cross section plan view of a removable oven on a grill 05, depicting a cooking chamber 26 in a high temperature housing 20 with a pair of cooking plates 30, and a chimney 244.
Figure 7:
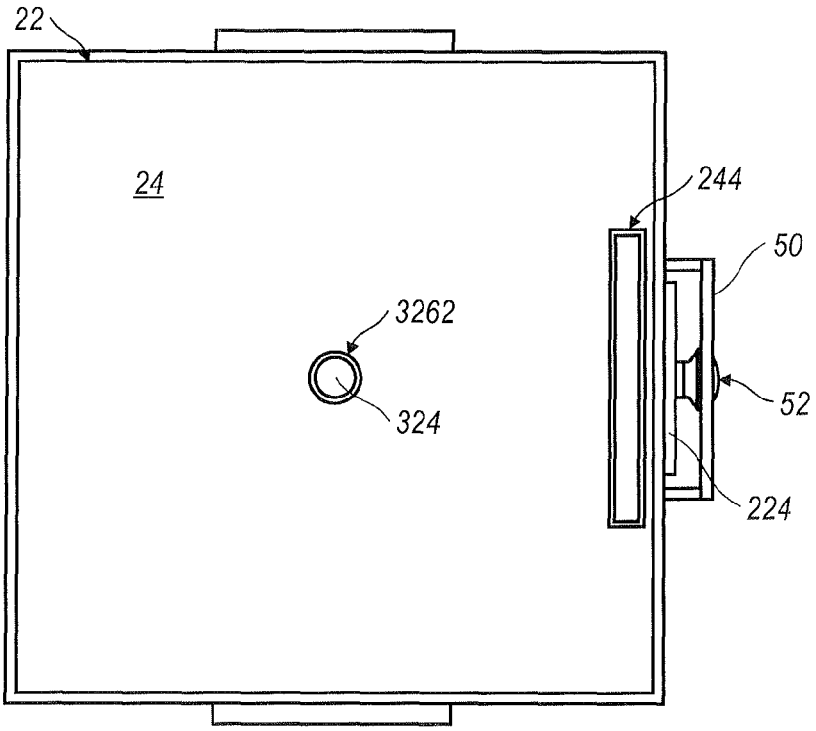
FIG. 7 is a top view of a removable oven depicting a stem 324 protruding through a stem aperture 326 formed in a top housing 24.
Figure 8:
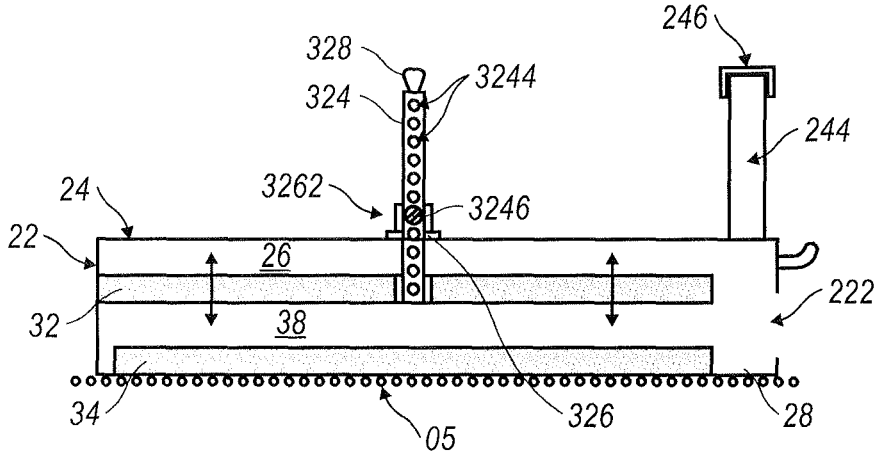
FIG. 8 is a cross section plan view of a removable oven depicting a cooking chamber 26 in a high temperature housing 20 with a pair of cooking plates 30 with an upper cooking plate 32 that can be adjusted by a stem 324 with a series of holes 3244 and a pin 3246.
Figure 9:
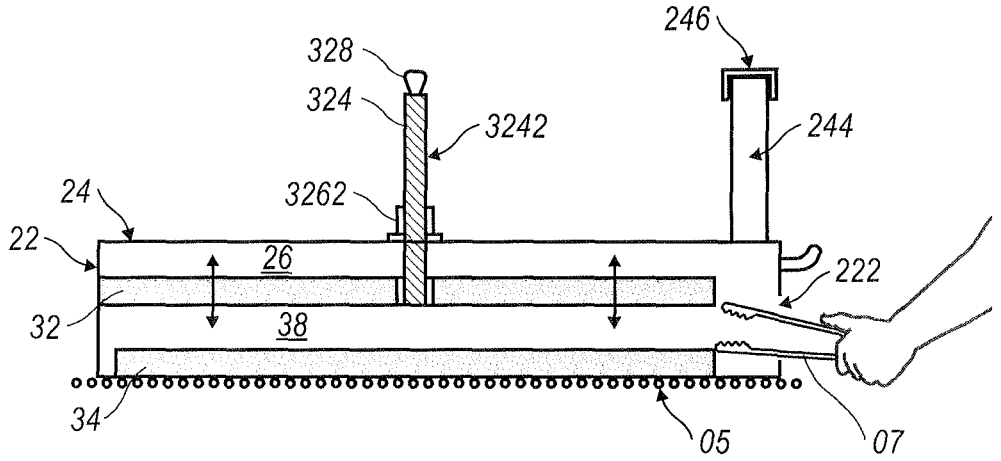
FIG. 9 is a cross section plan view of a removable oven depicting a cooking chamber 26 in a high temperature housing 20 with a pair of cooking plates 30 with an upper cooking plate 32 that can be adjusted by a threaded stem 3243.

As depicted in FIG. 6, a lower cooking plate 34 is positioned on the grill 05 inside the open bottom 28. A repositionable upper cooking plate 32 is located in an upper region 262 of the cooking chamber 26. See FIGS. 5, 6, 8 and 9. The cooking plates 32 and 34 can be square, rectangular, polygonal and/or circular so long as the upper and lower surfaces are flat. The cooking plates 32 and 34 are made from materials that are food safe and with a thickness capable of absorbing and radiating heat at high temperatures as described above. It is contemplated that such cooking plates 32 and 34 are made from ceramic materials, earthenware, stoneware or a combination thereof.

Figure 3:
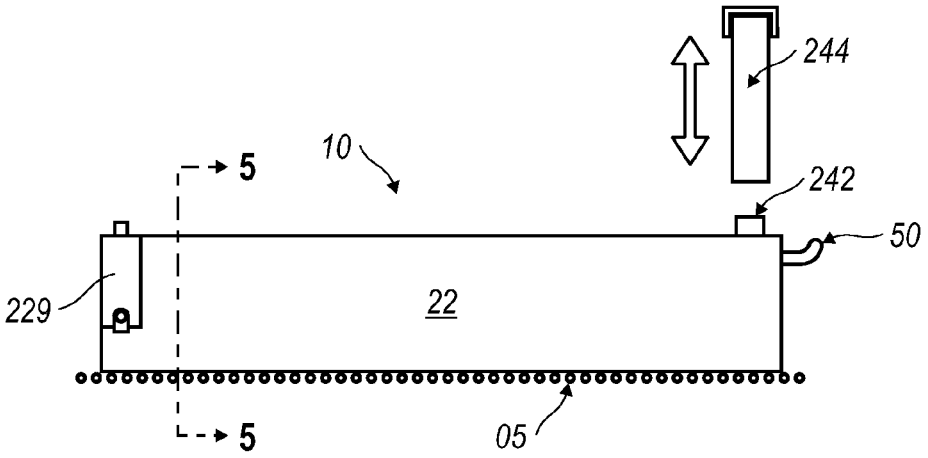
FIG. 3 is a side view of a removable oven depicting the back cover 229, chimney 244 and door 224.
Figure 4:
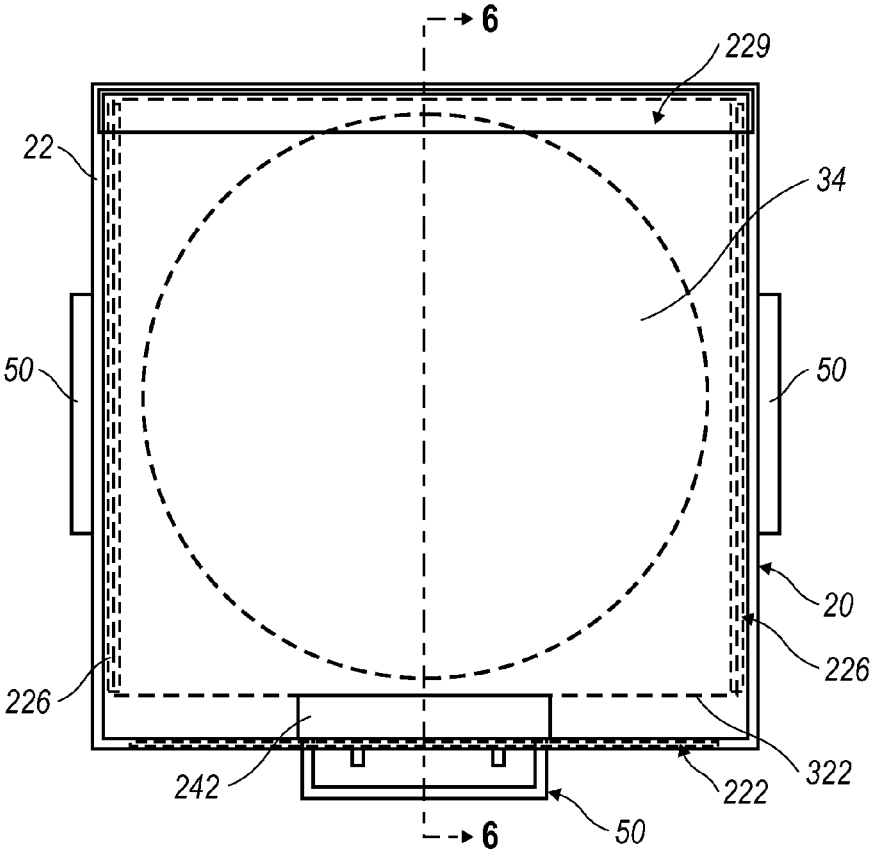
FIG. 4 is a top view of a removable oven depicting the upper cooking plate 32 and lower cooking plate 34 within a high temperature housing 20.
Figure 5:
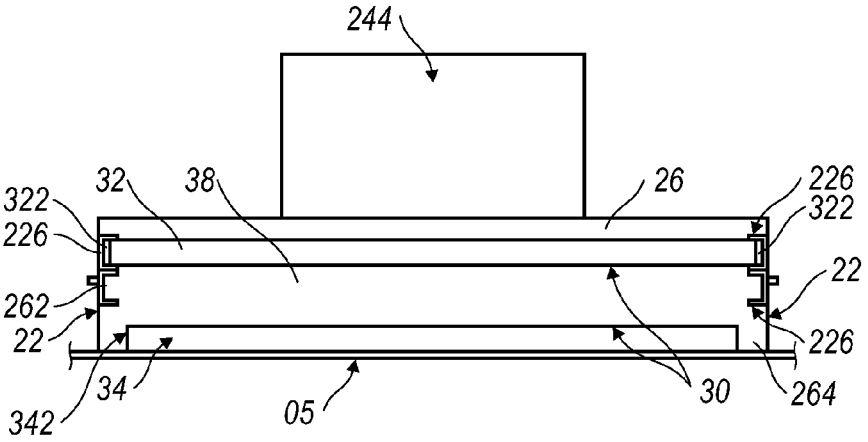
FIG. 5 is a cross section plan view of a removable oven depicting the chimney 244, pair of cooking plates 30 within a cooking chamber 26 and a heating gap 38.

The cooking plates 32 and 34 should have a periphery 322 and 342 that are less than the periphery of the cooking chamber 26. A smaller periphery 322 of an upper cooking plate 32 allows the upper cooking plate 32 to be inserted into the high temperature housing 20 through a back opening 228 formed in a side wall 22 and covered by a back cover 229. See FIGS. 3 and 4. A lower cooking plate 34 that is smaller than the open bottom 28 creates an unobstructed space around the periphery 342 of the lower cooking plate 34 thereby allowing heated air to flow into the cooking chamber 26 to heat the upper cooking plate 32. See FIG. 6. The lower cooking plate is heated directly by the heat source 03 and or by air heated by the heat source 03. In a preferred embodiment, the upper cooking plate 32 has a larger surface area that the lower cooking plate 34.

In one embodiment at least two pair of opposing rails 226 are fixed in the upper region 262 of the cooking chamber 26 to receive and hold the upper cooking plate 32 at pre-determined heights above the lower cooking plate to form a variable heating gap 38. See FIGS. 5 and 6. In another embodiment, a stem 324 projects upward from the upper repositionable cooking plate and through a stem aperture 326 formed in the closed top 24 and further through a securing boss 3262 fixed to the closed top 24. See FIGS. 8 and 9. In one variation of this embodiment, a plurality of holes 3244 are formed in the stem 324, each with a diameter sufficient to receive a pin 3246 of a sufficient length to rest across the securing boss 3262. See FIG. 8. As can be appreciated, this stem arrangement allows a the upper cooking plate 32 to be repositioned to pre-determined heights thereby allowing the heating gap 38 to be varied. In yet another variation of this embodiment, the stem 324 and the securing boss 3262 are threaded thereby allowing a user to vary the heating gap 38 as the situation dictates. Varying the heating gap 38 as described in the embodiments above gives the user a greater degree of control over the cooking temperature between the cooking plates 32 and 34. A thermometer 40 can be positioned on the closed top 24 or a side wall 22 to measure the temperature of the cooking chamber 26, heating gap 38, chimney or a combination thereof. See FIG. 1.

A chimney 244 is fitted over a chimney opening 242 formed in the closed top 24 of a high temperature housing 20 to alter heating efficiency of the cooking chamber 26 and the air flow through the heating gap 38. The flow of air through the heating gap 38 can be varied by covering all or a portion of the chimney 244 with a chimney cover 246.

Figure 10:
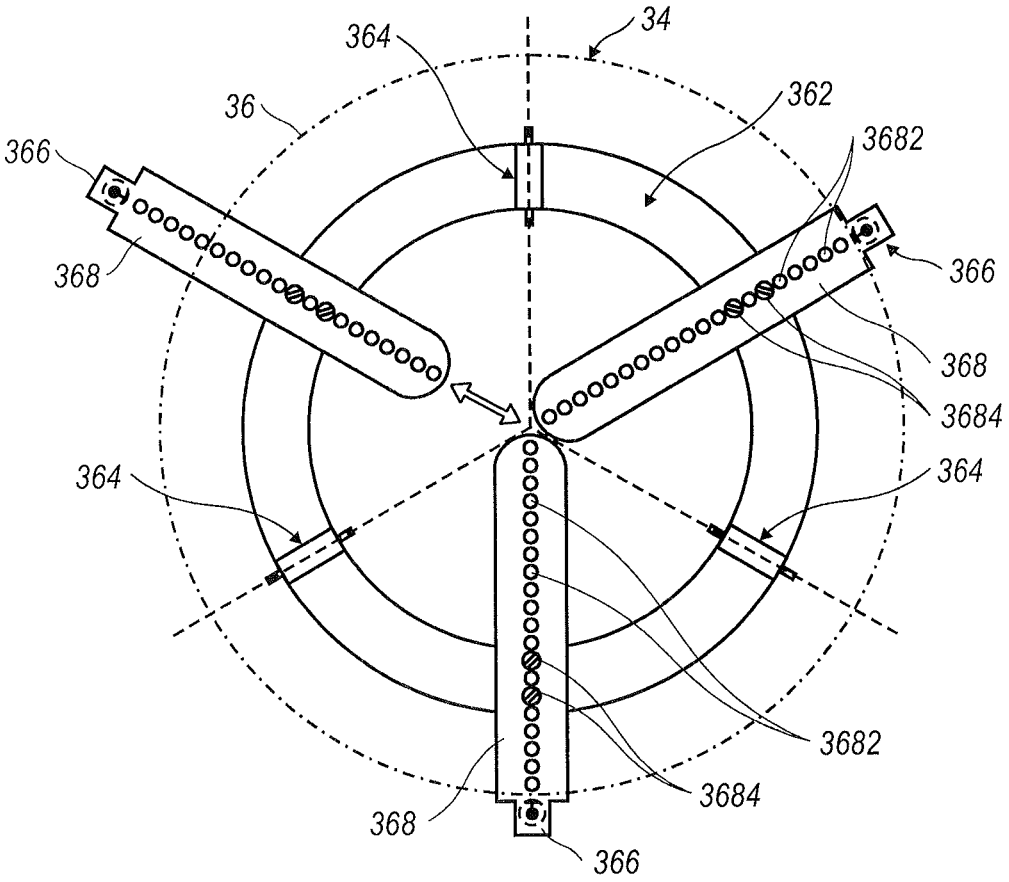
FIG. 10 is a top view of a rotating assembly 36 for a lower cooking plate 34.

In a preferred embodiment of the removable oven, the lower cooking plate 34 is capable of rotation by a user. Rotation is achieved by positioning the lower cooking plate 34 upon a rotating assembly 36 that is in contact with grill 05. The lower cooking plate 34 rests upon at least three base rollers 364 fixed to and above a frame base 362. See FIG. 10. The base rollers 364 are equidistant from each other and in contact with a lower surface of the lower cooking plate 34. The lower cooking plate 34 is kept positioned upon the base rollers 364 by at least three equidistant side rollers 366 fixed to and above the frame base 362 by at least three struts 368, one for each side roller 366. See FIG. 10. The side rollers 366 are in contact with a periphery of the lower cooking plate 34. A plurality of strut holes 3682 are formed along the longitudinal axis of each strut 368 to receive a removable securing pin 3684. See FIG. 10. At least two corresponding holes are formed in the frame base 362, each capable of receiving a removable securing pin 3684. The strut 368, strut holes 3682 and securing pin 3684 arrangement allows a user to adjust the side roller 366 in or out from the center of the rotating assembly 36 to accommodate the size of the lower cooking plate 34. In a preferred embodiment, six securing pins 3684, two for each strut 368, are used to secure each strut 368 to the frame base 362. See FIG. 10. In a preferred embodiment, each securing pin 3684 is of sufficient length to extend below the grill 05 and between the gaps between adjacent grill bars to provide a stop 3686 that prevents the frame base 362 from excessive lateral movement upon grill 05. In another embodiment, a stop 3686 extends away from the bottom of frame base 362 fitting between a gap between adjacent grill bars. The frame base 362, rollers 364 and 366, struts 368, securing pins 3684 and stops 3686 are made of high temperature materials similar to the high temperature housing 22 or the cooking plates 34. The user can rotate the lower cooking plate 34 by a high temperature utensil 07 passing through the front opening 222 and pushing (or pulling) the periphery of the lower cooking plate 34.

As depicted in FIG. 1, handles 50 can be mounted on the sides of the high temperature housing to allow for easy of transportation to/from the grill 05. It is contemplated that a knob 52 can be mounted on the door 224 to for ease of use of the door 224. In a preferred embodiment, the knob 52 is insulated. It is further contemplated that a handle 50 can be mounted on the side wall 22 above the front opening 222 to allow the high temperature housing to be swung up to expose the lower cooking plate 38. See FIG. 1.

Although the present invention and its advantages have been described in detail, it should be understood that various changes, substitutions and alterations can be made herein without departing from the spirit and scope of the invention as defined by the claims set forth below.

What is claimed is:

1. A removable oven for use on a cooking grill comprising:

a cooking chamber formed in a high temperature housing sitting on the cooking grill, said high temperature housing comprising a closed top, an open bottom and at least one side wall;

a circular lower cooking plate positioned on a rotating assembly positioned on the cooking grill inside said open bottom;

a handle fixed to outer surface of said at least one side wall to allow said high temperature housing to be swung up to expose said lower cooking plate;

said rotating assembly comprising a base which rests upon the grill, at least three base rollers fixed to and above said base, said base rollers positioned equidistant from each other and in contact with a lower surface of said lower cooking plate, and at least three side rollers, each fixed to an adjustable strut above said base positioned equidistant from each other and in contact with a periphery of said lower cooking plate, wherein said lower cooking plate is rotated about said center axis by a user controlled high temperature utensil when said high temperature housing is swung up by said handle;

a repositionable upper cooking plate located in an upper region of said cooking chamber, said upper cooking plate opposing said lower cooking plate to form an adjustable heating gap within said cooking chamber;

a chimney positioned over a chimney opening formed in said closed top and fluidly connected to said cooking chamber.

* * * * *